US006334579B1

(12) United States Patent
Zarbi

(10) Patent No.: US 6,334,579 B1
(45) Date of Patent: Jan. 1, 2002

(54) AIR ATOMIZING NOZZLE

(75) Inventor: Ghassem Zarbi, North Vancouver (CA)

(73) Assignee: Honeywell Measurex Devron Inc., North Vancouver (CA)

( * ) Notice: Subject to any disclaimer, the term of this patent is extended or adjusted under 35 U.S.C. 154(b) by 0 days.

(21) Appl. No.: 09/253,134

(22) Filed: Feb. 18, 1999

(51) Int. Cl.[7] ..... B05B 7/10
(52) U.S. Cl. ..... 239/406; 239/405; 239/423
(58) Field of Search ..... 239/399, 403, 239/405, 406, 418, 422, 423, 429, 430, 433, 434

(56) References Cited

U.S. PATENT DOCUMENTS

| | | | | |
|---|---|---|---|---|
| 1,342,732 A | * | 6/1920 | Anthony | |
| 1,547,349 A | * | 7/1925 | Reichenbach | |
| 4,946,101 A | | 8/1990 | Winheim | 239/8 |
| 5,921,470 A | * | 7/1999 | Kamath | 239/406 |

FOREIGN PATENT DOCUMENTS

EP 0 028 088 5/1981

OTHER PUBLICATIONS

Measurex Corporation, "Measurex M X Open Cross Direction Profile Control" brochure, pp. 7–8, Canada, at least as early as 1997.*

Honeywell Measurex Devron, Inc., "AquaTrol Remoisturizing System" leaflett, front/back, Canada, at least as early as 1997.*

Vyse, R. et al., "CD Moisture Profiling by Remoisturizing with Water Sprays", Tappi Practical Aspects of Pressing and Drying Short Course, Mar., 1997, pp. 1–9, Canada.*

* cited by examiner

*Primary Examiner*—Lesley D. Morris
(74) *Attorney, Agent, or Firm*—Christie, Parker & Hale, LLP

(57) ABSTRACT

A nozzle assembly for converting liquid from a liquid source into a spray flow using air from an air pressure source to atomize the liquid. The nozzle assembly comprises a housing having an air inlet for connection to the air pressure source, a liquid inlet for connection to the liquid source, and an outlet. A series of first air passages are formed in the housing for receiving air from the air inlet. The first air passages communicate with the outlet and are configured to generate a swirled air stream. A second air passage in the housing is also provided and is configured to generate a linear air stream. There is a liquid passage for receiving liquid from the liquid inlet. The liquid passage contracts to a reduced cross-sectional area adjacent the housing outlet. The first and second air passages and the liquid passage terminate in a common atomization zone adjacent the housing outlet where liquid flowing through the liquid passage is atomized into a spray pattern. The nozzle design allows the spray flow rate to be infinitely varied between minimum and maximum water flow rates with good atomization over the entire range of flow rates using significantly reduced air pressures than is conventional. The nozzles provide a uniform flow distribution pattern that is desirable in applications such as cross-direction moisture control in the papermaking industry.

11 Claims, 6 Drawing Sheets

AIR ATOMIZING NOZZLE

FIELD OF THE INVENTION

This invention relates generally to the field of nozzles for producing a water spray, and more particularly to a nozzle for use in papermaking machinery that produces a water spray using air atomization for remoisturizing a web of paper under manufacture.

BACKGROUND OF THE INVENTION

Conventional papermaking machinery for producing a continuous sheet of paper includes equipment to set the sheet properties of the paper as it is being manufactured. Generally, on-line measurements of sheet properties, such as thickness, moisture, gloss or smoothness are made by scanning sensors that travel back and forth across the width of the sheet of paper in the cross-machine direction (CD). The scanning sensors are located downstream of actuators that are controlled to adjust the sheet properties. The scanning sensors collect information about the sheet properties to develop a property profile across the sheet and provide control signals to the appropriate actuators to adjust the profile toward a desired target profile in a feedback loop. In practice, the actuators provide generally independent adjustment at adjacent cross-directional locations of the sheet, normally referred to as slices or profile zones.

One of the more basic operations on a paper machine is control of the cross-direction moisture profile by remoisturizing with water sprays administered by spray nozzles. By applying water to the drier areas of a sheet, a uniform CD moisture profile can be created.

There are two predominant remoisturizing systems in use today that both rely on water spray nozzles positioned along the cross-machine direction. These systems are distinguished by the different nozzles that are used—air atomized and hydraulic atomized nozzles. Typically, air atomized nozzles produce a hollow or solid conical spray that delivers water in a generally circular pattern. Air pressure or the air/water ratio are varied to adjust between the hollow and solid spray patterns. Hydraulic nozzles produce a flat fan spray that delivers water in a generally elliptical pattern. Conventionally, both systems employ 4-bit logic so that 16 different water flows are possible per CD profile zone by various on/off combinations of the nozzle control solenoids.

Air atomized systems generally comprise a boom that extends in the cross-machine direction equipped with a single nozzle per profile zone with 4 off-machine solenoids per nozzle that provide the required 16 water flow rates. A 100 mm CD profile zone width is standard.

Hydraulic atomized systems also generally consist of a boom extending in the cross-machine direction, however, each profile zone is conventionally defined by 4 nozzles producing discrete, flat fan sprays that overlap without intersecting. CD moisture profile zone width is variable down to 50 mm with 100 mm being the most common spacing.

SUMMARY OF THE INVENTION

Applicant has developed an air atomizing nozzle that has advantages over existing nozzles. The present invention provides a nozzle assembly for converting liquid from a liquid source into a spray flow using air from an air pressure source to atomize the liquid comprising:

a housing having an air inlet for connection to the air pressure source, a liquid inlet for connection to the liquid source, and an outlet;

at least one first air passage in the housing for receiving air from the air inlet, the at least one first air passage communicating with the outlet and being configured to generate a swirled air stream;

a second air passage in the housing for receiving air from the air inlet, the second air passage communicating with the outlet and being configured to generate a linear air stream;

a liquid passage for receiving liquid from the liquid inlet, the liquid passage contracting to a reduced cross-sectional area adjacent the outlet; and the first and second air passages and the liquid passage terminating in a common atomization zone adjacent the housing outlet where liquid flowing through the liquid passage is atomized into a spray pattern.

The nozzle of the present invention has a unique construction with multiple air passages and a constricted water passage that relies on substantially constant low air pressure in the range of 2.5 to 4.0 psi to achieve adequate spray characteristics over a broad range of spray flow rates. Prior art air atomization nozzles generally require high capacity compressed air systems operating in the region of 15 p.s.i.

Instead of relying on four-bit logic control limited to 16 discrete flow steps, the nozzles of the present invention are sufficiently flexible that they can provide an infinite range of water flows between current minimum and maximum industrial flow rates by adjusting the water flow rate to the nozzle with good atomization over the entire range of flows. This allows the nozzles to be used for CD moisture control for all grades of paper from fine specialty paper to heavier board. As well, control solenoids can be reduced from four to one per zone as the nozzles are not limited to four-bit logic. The nozzles of the present invention can also be operated using the four-bit logic control of the prior art.

In a preferred embodiment, the nozzles of the present invention are of a modular design that allows different inserts with different spray characteristics to be used depending on the paper being manufactured.

The nozzles of the present invention tend to have a uniform CD flow distribution pattern resulting in much flatter zone spray profiles.

The spray patterns produced by the nozzle of the present invention tend to be smaller while maintaining good atomization with the result that the minimum profile zone spacing using the present nozzle can be half of the current minimum spacing. The smaller spray width also provides more consistent discrete zone control.

The nozzles of the present invention use larger orifices than prior art designs which reduces clogging problems.

In view of the above-described advantages, the nozzle design of the present invention tends to be easier to maintain resulting in lower maintenance costs and less overall cost.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
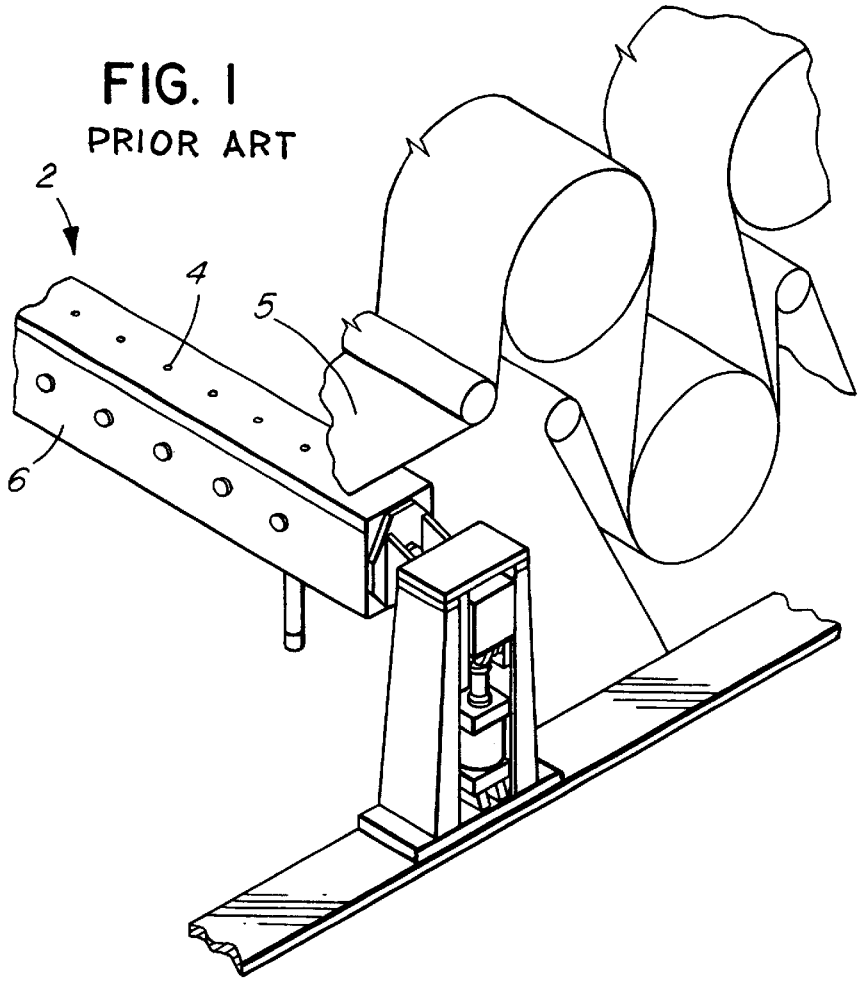
FIG. 1 PRIOR ART
FIG. 1 is an illustration of a typical remoisturizing system equipped with spray nozzles for use in the papermaking industry.

Referring to FIG. 1, there is shown a typical remoisturizing system 2 for applying water sprays from nozzles 4 to a sheet 5 of paper under manufacture. Nozzles 4 are arranged in a boom 6 that extends in the cross-machine direction below the sheet of paper 5. Boom 6 also houses the air and water lines, power cables and controlling electronics that permit nozzles 5 to be operated to apply water in spray form to those CD profile zones of the paper web that require moisture in order to obtain a desired moisture profile across the entire web. The above described construction is conventional.

Figure 2:
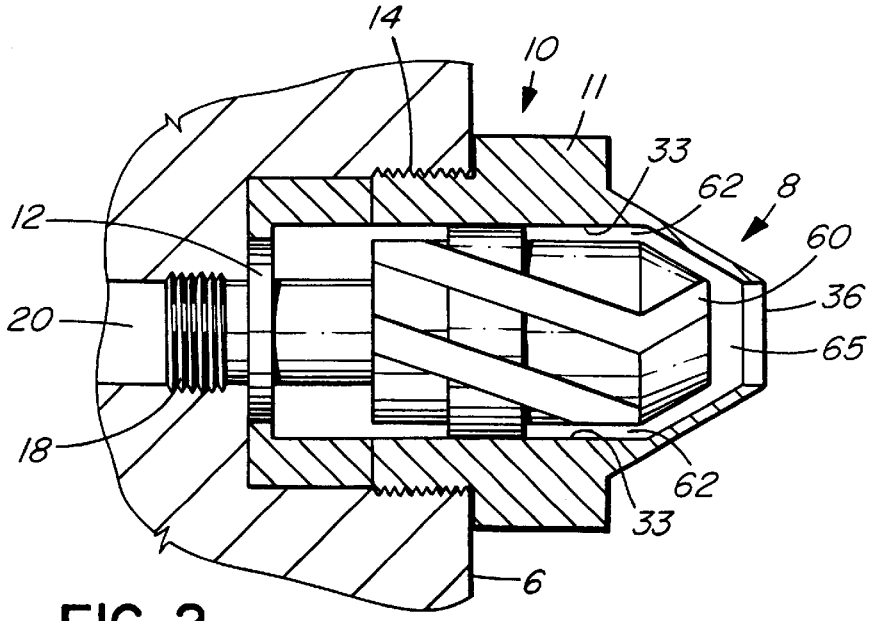
FIG. 2 is a detail view of a nozzle according to a preferred embodiment of the present invention showing the outer casing and an installed nozzle insert.

Referring to FIG. 2, there is shown a preferred embodiment of the nozzle assembly 8 of the present invention adapted for use in a conventional boom structure for converting liquid supplied by water lines into a spray flow using air from an air pressure source. Nozzle assembly 8 comprises a housing 10 that is installable into a fixed location in boom 6. In a preferred embodiment, nozzle assembly 8 is of modular construction and housing 10 is formed from a hollow outer casing 11 into which an insert 12 is fitted. Outer casing 11 includes a threaded base 14 adapted for engagement in a correspondingly threaded opening in boom 6.

Nozzle assembly 8 is connectable via an air inlet to an air pressure source (not shown). Insert 12 is formed with a threaded connection 18 defining a liquid inlet to the nozzle for connection via line 20 to the liquid source (not shown) via a proportional valve (not shown).

Figure 3:
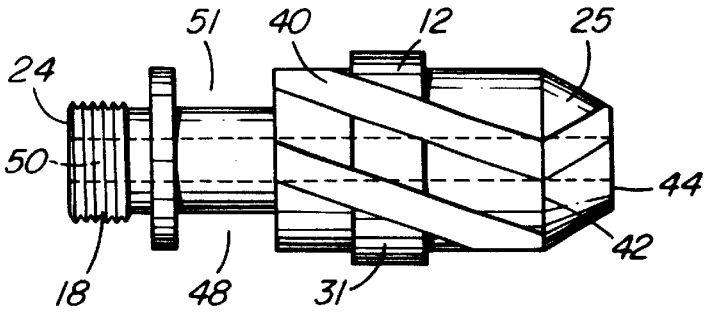
FIG. 3 is a detail view of a nozzle insert according to the present invention.
Figure 4:
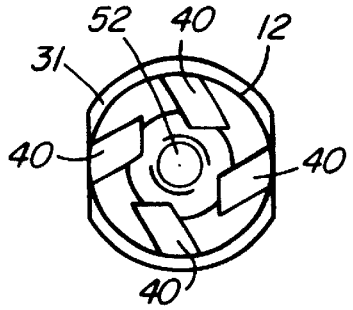
FIG. 4 is an end view of the nozzle insert shown in FIG. 3 showing the tip of the insert.

Referring to FIGS. 3 and 4, there are shown side and end views, respectively, of insert 12 which is a generally cylindrical body extending from end 24 formed with connection 18 to a narrowed tip. As illustrated, in the preferred embodiment, insert 12 is formed with a generally truncated frusto-conical tip 25. Insert 12 is also formed with a plurality of channels 40 over the external surface of the insert. Channels 40 are spaced apart from each other and each extends in a generally spiral pattern about the insert body to the frusto-conical tip 25. At edge 42 defining the base of tip 25, each channel 40 turns and extend across the conical surface of the tip at an angle to the longitudinal axis of the insert to end at the truncated surface 44 of the tip.

Insert 12 is also formed with a liquid passage 50 that extends along the longitudinal axis of the insert from connection 18 to tip 25. As best shown in FIG. 4, passage 50 ends at central opening 52 in truncated surface 44 of tip 25. Opening 52 is centred between the spaced ends of channels 40. Passage 50 is formed with an internal contraction to a reduced cross-sectional area adjacent opening 52 as will be described in more detail below.

Insert 12 includes an annular groove 48 adjacent end 24 which defines a chamber 51 for distribution of air through the nozzle as will be described in more detail below.

Figure 5:
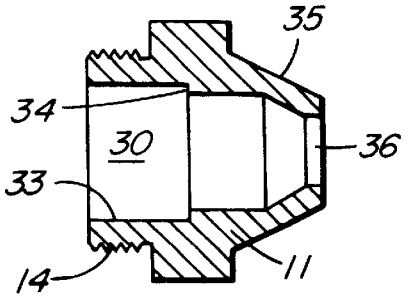
FIG. 5 is a section view through an outer casing of the nozzle designed for external atomization of the water.
Figure 6:
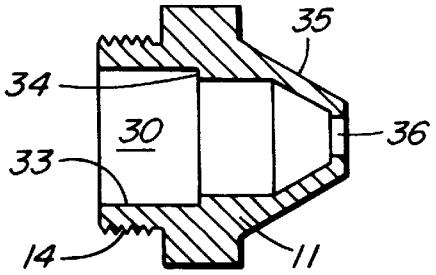
FIG. 6 is a section view through an alternative outer casing designed for internal atomization of the water within an atomization chamber.

In use, insert 12 is inserted into hollow outer casing 11 to complete the nozzle assembly. FIGS. 5 and 6 are sectioned views of hollow outer casing 11 which is formed with an internal cavity 30 to receive insert 12. Outer casing 11 includes a truncated generally frusto-conical tip 35 that conforms generally to tip 25 of insert 12, and includes an outlet 36 for exiting of atomized spray from the nozzle assembly. Insert 12 is formed with an annular flange 31 and the inner walls 33 of internal cavity 30 are formed with an annular shoulder 34 to engage with flange 31 to reliably and accurately position insert 12 within outer casing 11 so that insert tip 25 is properly positioned with respect to outlet 36.

As best shown in FIG. 2, when insert 12 is inserted into outer casing 11, the insert 12 and casing are dimensioned such that spiral channels 40 of insert 12 are positioned adjacent inner walls 33 of casing 11 and define first air passages 60 in the nozzle to generate a swirled air stream adjacent outlet 36 of the outer casing. In a similar manner, insert 12 is dimensioned such that there is an annular space between inner casing walls 33 and the cylindrical body of insert 12 to define a second air passage 62 to generate a linear air stream adjacent outlet 36 of outer casing. The annular space is preferably a tolerance gap between the inner casing walls and insert 12.

Chamber 51 formed in insert 12 defines a region in communication with the air inlet where division and distribution of the air flow into the first and second air passages occurs well away from outlet 36 so that there is an opportunity for well established swirling and linear airstreams to be established.

Central liquid passage 50 through insert 12 delivers water from the liquid source to adjacent casing outlet 36. In the assembled nozzle, first and second air passages 60 and 62, respectively, and liquid passage 50 all terminate in a common atomization zone 65 adjacent the casing outlet 36 where water flowing through the liquid passage is atomized into a spray pattern.

The first and second air passages are configured and arranged such that the passages exert minimal force on the incoming fluid so that changes in air pressure in the nozzle do not alter the incoming fluid rate.

In the atomization process of the water into small particles or droplets, there are two types of forces at work—mechanical forces which arise primarily due to the turbulent flow of water in the liquid passage caused by the contraction in the nozzle and aerodynamic forces which arise due to air pressure differences and the influence of the air streams created by the air passages of the present invention. This two types of forces co-operate in the nozzle design of the present invention to efficiently and reliably break up the water into fine particles.

The swirled air stream generated by the first air passages creates a turbulent vortex adjacent liquid passage opening 52. The general turbulence promotes atomization of the liquid and the vortex tends to break the fluid into finer particles by increasing the tangential velocity of the water exiting opening 52. The swirled air stream tends to generate low air pressures adjacent the nozzle tip which helps to prevent larger water particles with a high velocity from striking the paper sheet at the nozzle until the larger particles have had an opportunity to be broken down into smaller particles. The swirled air stream also permits control over spray angle and, in turn, spray width and particle size.

The linear air stream also plays an important role in the nozzle of the present invention. The linear air stream is provided to deliver sufficient momentum to the atomized water particles of the spray to carry the particles through the air boundary layer that tends to form near the surface of a paper sheet under manufacture due to the movement of the sheet in the machine direction at speeds of up to 80 km/hr.

Figure 4A:
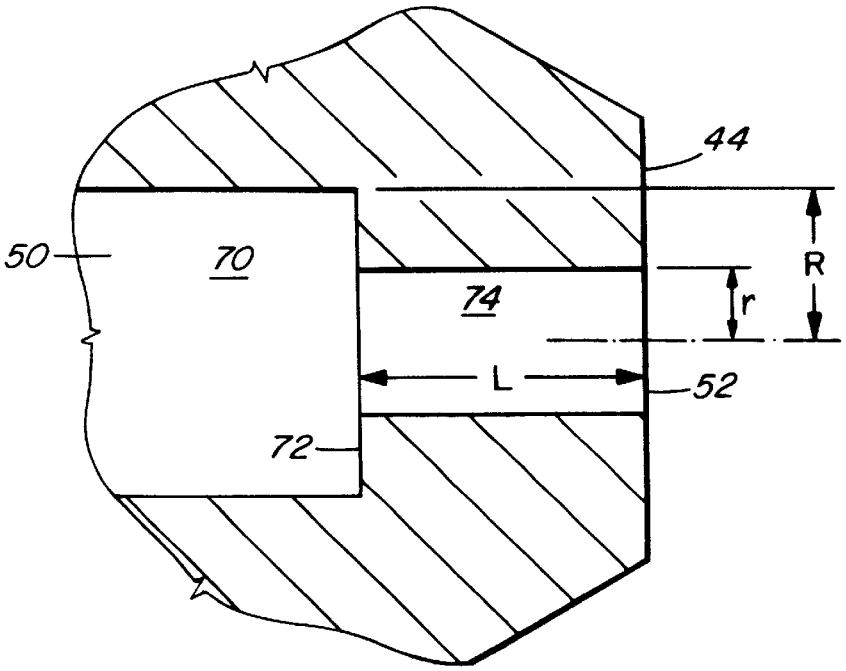
FIG. 4*a* is detail cross-sectional view of the liquid passage through the nozzle insert.

Liquid passage 50 of the nozzle assembly of the present invention is also formed to assist in atomization of the water. FIG. 4*a* is a detail section view of the tip 25 of insert 12 in the region where liquid passage 50 intersects truncated surface 44 at opening 52. Liquid passage 50 has generally circular cross-section with a first portion 70 having a cross-section of radius R that extends along the majority of the length of insert 12. Adjacent opening 52 in insert tip 25, however, passage 50 contracts to a second portion 74 with a smaller cross-section of radius r. In the illustrated embodiment, the contraction is created by a stepped surface 72, however, other contraction configurations are possible. Step 72 occurs at a distance L from the end of the liquid passage. Water flow through passage 50 accelerates rapidly through the contraction, and a recirculation zone develops in the first portion 70 of the passage. The recirculation zone tends to create turbulent flow which assists in breakup of the water into finer particles. The water in passage 50 is also at relatively low pressure with the result that the swirled and linear air streams created by the nozzle assembly are able to effect and control the spray characteristics of the nozzle.

Furthermore, the dimensions r, R and L can be changed to vary the performance of the nozzle. The velocity of water will increase as the ratio r:R gets smaller. Changing these dimensions is easily achieved by virtue of the modular nature of the nozzle design. Insert 12 which is formed with liquid passage 50 can be readily removed from outer casing 11 and an alternative insert with different dimensions r, R and L inserted to adjust the performance of the nozzle.

Based on experimental results, a length L of 8 mm for portion 74 was determined to generate an optimum spray distribution with a ratio of r:R in the range of 0.6 to 0.8. It will be understood that other r:R ratios are possible. As ratio r:R changes or water or air pressures are varied, length L will also vary. For length L to have an effect on the width of the spray pattern, it was determined that L should be in the range of 2.5 to 8 mm.

Water is supplied to each nozzle of the present invention via a proportional valve that is capable of varying the flow rate in accordance with control signals from the feedback control system. After the valve, the water pressure is at essentially atmospheric pressure as it enters liquid passage 50. At this water pressure and using the preferred r:R ratios and length L mentioned above, it has been determined that a preferred air pressure range for the nozzle of the present invention is 2.5 to 4 psi. For a particular application, the nozzles would be set to operate at a constant air pressure. This air pressure range is capable of adequately and reliably atomizing water over the full range of water flow rates currently used in the industry in various papermaking applications. This air pressure is significantly lower than the air pressure relied upon in conventional air atomizing nozzle systems with the result that the nozzle of the present invention avoids the costs associated with high air pressure compressors.

Another feature of the nozzle of the present invention is that it can be readily modified to operate with an atomization zone 65 that is internal or external to the nozzle assembly by switching outer casing 11. FIGS. 5 and 6 show cross-sections through two outer casings 11 having appropriate internal dimensions designed to create external and internal atomization zones, respectively. Each outer casing includes a generally conical tip 35 formed with opening 36.

In the case of the external atomization casing of FIG. 5, shoulder 34 is positioned to engage insert flange 31 such that insert tip 25 extends all the way to outer casing opening 36 on insertion of the insert into the outer casing so that atomization zone 65 is external to the outer casing. Opening 36 is enlarged to accommodate tip 25.

In the case of the internal atomization casing of FIG. 6, shoulder 34 is positioned to engage insert flange 31 such that insert tip 25 extends to a point short of the outer casing opening on insertion of the insert into the outer casing. This arrangement results in a small inner region within outer casing 11 between insert tip 25 and opening 36 to define an atomization zone 65 internal to the outer casing where the liquid is converted into a spray prior to exiting the outer casing.

The external atomization zone allows adjustment of the air and water pressures independently to produce fine or coarse sprays. The internal atomization zone allows for adjustment of either air pressure or water flow rate with a resulting automatic change in the other parameter.

It should be noted that both the internal and external atomization outer casings have larger openings 36 than conventional nozzles which reduces clogging problems with the nozzles of the present invention.

With both the internal and external atomization zone configurations, the same general air pressure range of 2.5 to 4.0 psi has been found to produce a desirable spray pattern with appropriately sized particles over the range of water flows conventionally used in paper remoisturizing equipment.

Figure 7:
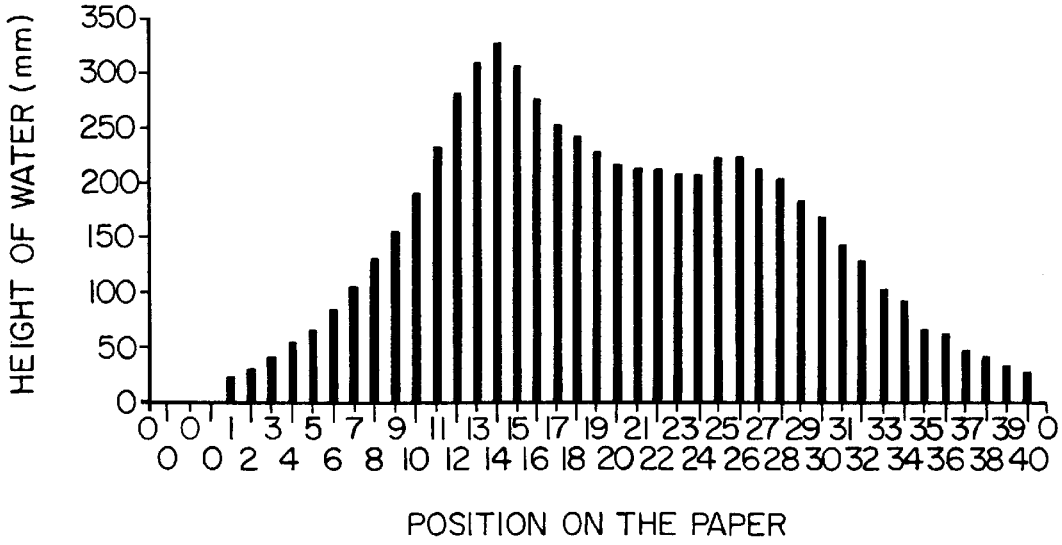
FIG. 7 PRIOR ART
FIG. 7 is a spray distribution pattern for an individual conventional air atomized nozzle.
Figure 8:
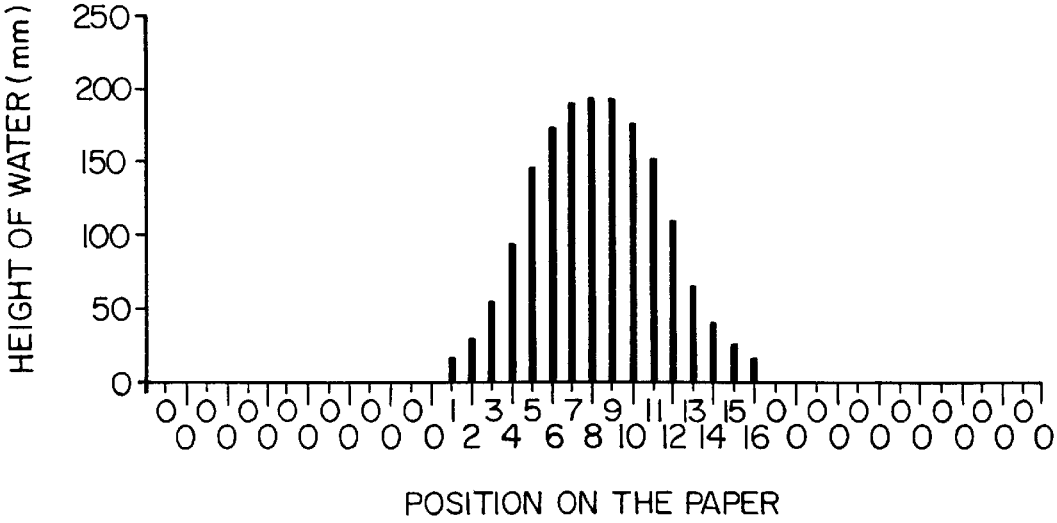
FIG. 8 is a spray distribution pattern for a single nozzle according to the present invention showing a significantly narrowed and more uniform spray distribution.

Both of the nozzle assembly's internal or external atomization zone configurations produce a general spray pattern that is a full cone formed from fine particles with an evenly distributed spray pattern. The spray pattern is very compact which permits smaller CD control profile zones to be established. FIGS. 7 and 8 show graphs demonstrating the spray distribution from a conventional air atomization nozzle and the nozzle of the present invention, respectively. The graphs of FIGS. 7 and 8 are generated by positioning a nozzle above a sloped surface formed with series of evenly spaced, sealed parallel channels of identical cross-section. The series of channels represent the surface of the paper sheet. Each channel drains into a vertical collection container and the height of water collected in each container is indicative of the spray delivered to a particular channel by the spray pattern. The resulting pattern of collected water is shown in FIGS. 7 and 8 and is indicative of the integrated volume of water delivered to the paper sheet over the entire spray pattern.

FIG. 7 is the spray distribution pattern for an individual conventional air atomized nozzle showing a very wide pattern (40 columns) and a non-uniform water height indicating uneven distribution of water within the spray pattern. The conventional nozzle was operated at its optimal air pressure in the range of 15 to 25 psi. When the conventional nozzle was operated at the 2.5 to 4 psi air pressures of the present invention, very coarse particles and poor atomization occurred.

In contrast, FIG. 8 shows the spray distribution pattern of a single nozzle according to the present invention operated at an air pressure range of 2.5 to 4 psi. The new nozzle produces a narrow spray pattern (16 columns) that is two and a half times narrower than the conventional nozzle with a regular and predictable water height indicating an uniform distribution of spray. These desirable characteristics are all produced at significantly reduced air pressures than is conventional. This narrower, uniform spray distribution allows for improved control of the CD moisture profile by permitting reliable control of smaller and more numerous CD profile zones.

Figure 9:
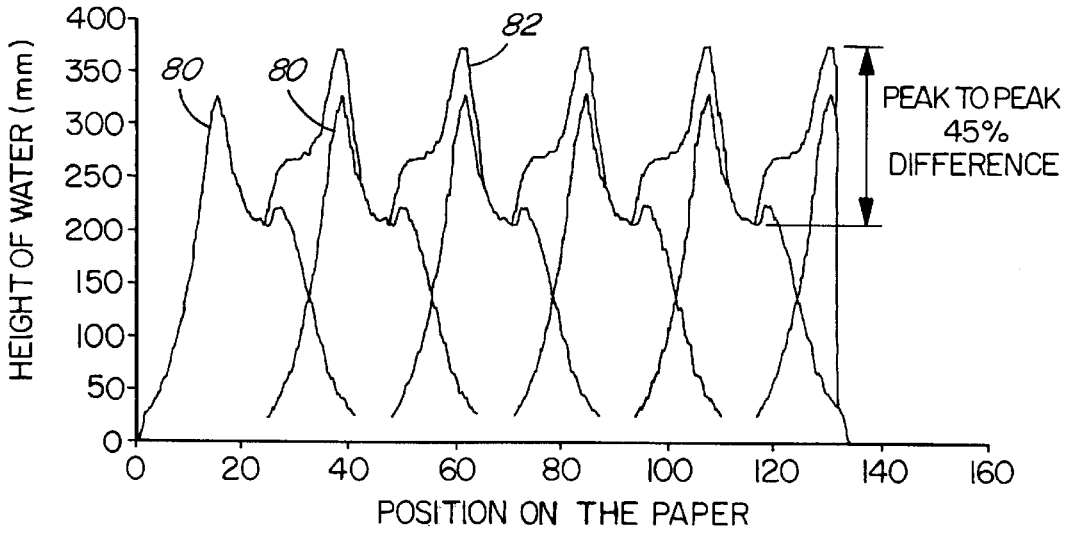
FIG. 9 PRIOR ART
FIG. 9 is a spray distribution pattern for an array of conventional air-atomized nozzles showing a fluctuating cumulative moisture profile.
Figure 10:
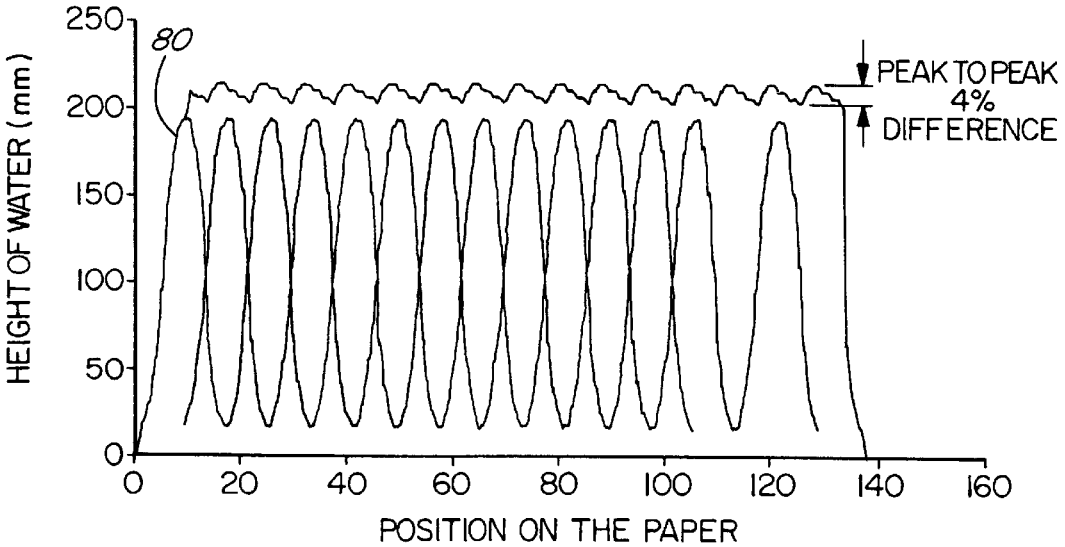
FIG. 10 is a spray distribution pattern for an array of nozzles according to the present invention showing a generally uniform cumulative moisture profile.

FIGS. 9 and 10 are spray distribution graphs similar to FIGS. 7 and 8, but for a series of adjacent nozzles as opposed to individual nozzles. FIG. 9 shows the spray distribution for 6 prior art air-atomized nozzles while FIG. 10 shows the spray distribution for 14 nozzles of the present invention. Once again, the prior art nozzles and the nozzles of the present invention were test at their different optimal air pressures. Much higher air pressures were necessary with prior art nozzles to achieve good atomization. As is conventional, for controllability of the moisture profile, individual nozzles are positioned such that there is only limited overlap of the individual spray patterns 80 to produce a cumulative moisture profile 82.

To ensure controllability of the cumulative moisture profile, it is desirable that the following guidelines be met:

1. The peak to peak values of the cumulative moisture profile must fall within 10% of each other.
2. There must only be first coupling between the spray patterns from adjacent nozzles.
3. The volume of spray from one nozzle defining a particular profile zone must not differ more than five percent from the volume of the overall spray within that zone (overall coupled and uncoupled volume within the zone).
4. There must not be more than 10% first coupling between the sprays from adjacent nozzles.

In the above guidelines:

$$\%\ \text{of coupling} = \frac{\text{coupled volume within the zone}}{\text{total volume within the zone}}$$

Nozzle spacing and the distance from the paper sheet also affect the percentage of coupling. A moisture profile with a high percentage of coupling is not controllable.

A review of the spray distributions shown in FIG. 9 indicates that the prior art nozzles do not meet the above criteria when operated at the air pressures appropriate for the nozzle of the present invention. The peak to peak values of the cumulative moisture profile vary by 45% which is far too large to provide a consistent moisture profile across the paper sheet. In contrast, FIG. 10 indicates that the nozzles of the present invention provide a very small 4% peak to peak value that is within the recommended guidelines. These results indicate that the nozzles of the present invention can be spaced closer together in the cross machine direction than conventional nozzles to provide more control zones and therefore, greater adjustment of the moisture profile of a papersheet under manufacture. While they are spaced more closely, the nozzles of the present invention still produce a relatively flat moisture profile with a very low percentage of coupling.

Figure 11:
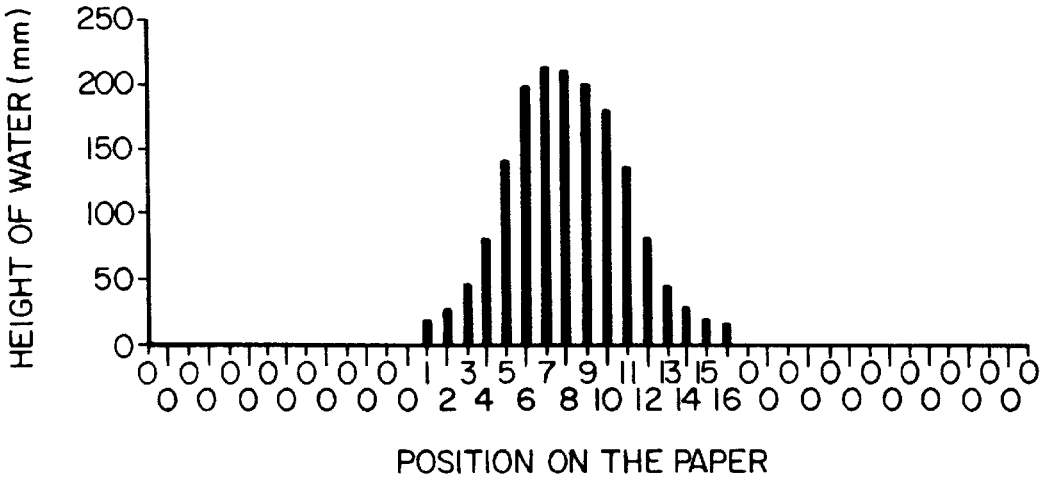
FIG. 11 is a spray distribution pattern for a single nozzle that does not incorporate the step restriction in the liquid passage.
Figure 12:
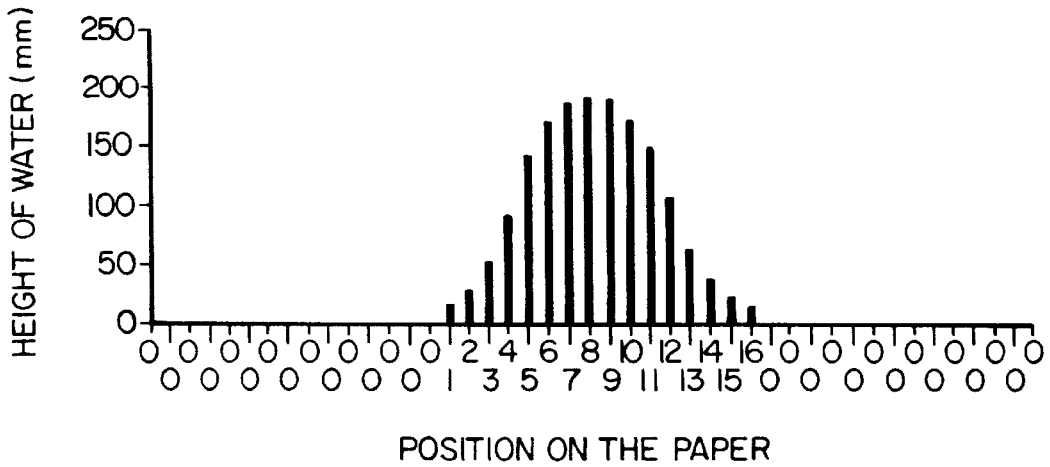
FIG. 12 is a spray distribution pattern for a single nozzle that includes the step restriction.
Figure 13:
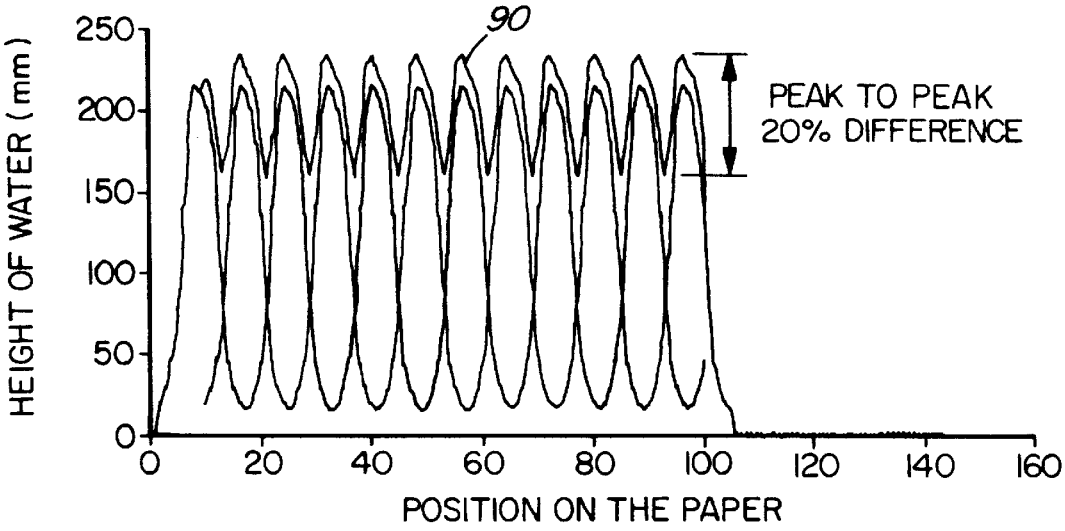
FIG. 13 is a spray distribution pattern for an array of non-restricted nozzles showing a non-useful cumulative spray pattern.
Figure 14:
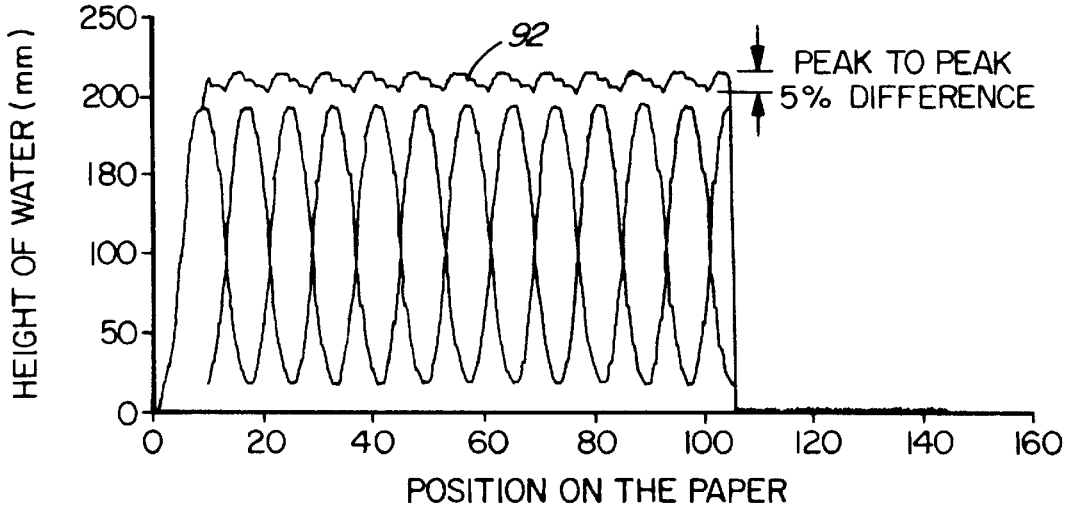
FIG. 14 is a spray distribution pattern for an array of restricted nozzles showing a generally flat, useful cumulative spray pattern.

FIGS. 11–14 have been included to demonstrate the importance of the constricted step in the liquid passage of the present invention in ensuring a uniform spray distribution that is useful in providing a controllable CD moisture profile. FIG. 11 is a spray distribution pattern for a single nozzle constructed according to the present invention except a constriction in liquid passage 50 is omitted. FIG. 12 is a spray distribution pattern for a nozzle that includes a constriction. Note that the spray pattern of the constricted nozzle is more uniform and symmetrical when compared to that of the nozzle without the constriction. FIGS. 13 and 14 are spray distribution patterns for arrays of nozzles without a constriction and with a constriction, respectively. In both cases, the nozzles have been positioned so that there is a desired 10% first coupling between adjacent nozzles. The cumulative spray pattern 90 of FIG. 13 produced by nozzles with unconstricted liquid passages has large peak to peak values of approximately 20% and the resulting moisture pattern is not useful. In contrast, the cumulative spray pattern of FIG. 14 is relatively uniform with only a 5% variation in peak to peak values by virtue of the uniform and symmetric spray pattern of the individual nozzles.

Although the present invention has been described in some detail by way of example for purposes of clarity and understanding, it will be apparent that certain changes and modifications may be practised within the scope of the appended claims.

I claim:

1. A nozzle assembly for converting liquid from a liquid source into a spray flow using air from an air pressure source to atomize the liquid comprising:

a housing having an air inlet for connection to the air pressure source, a liquid inlet for connection to the liquid source, the housing being formed from a hollow outer casing with an outlet, and an insert insertable into the casing, the outer casing having an inner wall defining a central cavity therethrough and the insert having a generally cylindrical body with an external surface, the body extending from a first end to a tapered tip;

a liquid passage through the insert for receiving liquid from the liquid inlet, the liquid passage contracting to a reduced cross-sectional area adjacent the insert tip to define a liquid opening at the at the insert tip;

a plurality of channels extending in a spiral configuration about the external surface of the body of the insert, each spiral channel turning at an angle at the tip to extend across the tapered surface of the tip and terminate at the liquid opening, the channels defining first air passages for receiving air from the air inlet that communicate with the outlet to generate a swirled air stream;

the insert and the central cavity being dimensioned such that insertion of the insert into the central cavity creates an annular space between the inner wall of the cavity and the external surface of the insert to define a second air passage for receiving air from the air inlet, the second air passage communicating with the outlet and being configured to generate a linear air stream;

the first and second air passages and the liquid passage terminating in a common atomization zone adjacent the outlet where liquid flowing through the liquid passage is atomized into a spray pattern.

2. A nozzle assembly as claimed in claim 1 in which the hollow outer casing includes a generally conical tip having an opening at the apex of the tip to define the outlet, and the insert is positioned such that the insert tip extends to a point short of the outer casing opening on insertion of the insert into the outer casing to define the atomization zone internal to the outer casing where the liquid is converted into a spray prior to exiting the outer casing.

3. A nozzle assembly as claimed in claim 1 in which the hollow outer casing includes a generally conical tip having an opening at the apex of the tip to define the outlet, and the insert is positioned such that the insert tip extends to the outer casing opening on insertion of the insert into the outer casing so that the atomization zone is external to the outer casing.

4. A nozzle assembly as claimed in claim 1 in which the insert includes an annular groove adjacent the first end of the generally cylindrical body to define a chamber in communication with the air inlet for distributing the flow of air into the first and second air passages.

5. A nozzle assembly as claimed in claim 1 including a chamber within the housing in communication with the air inlet for distributing the flow of air into the first and second air passages.

6. A nozzle assembly as claimed in claim 1 in which the atomization zone is internal to the housing.

7. A nozzle assembly as claimed in claim 1 in which the atomization zone is external to the housing.

8. A nozzle assembly as claimed in claim 1 in which the liquid passage is of generally circular cross-section and comprises a first portion with a cross-section of radius R that contracts at a step to a second portion with a smaller cross-section of radius R.

9. A nozzle assembly as claimed in claim 8 in which the step occurs at a distance L from the end of the liquid passage adjacent the housing outlet.

10. A nozzle assembly as claimed in claim 9 in which distance L is less than or equal to 8 mm.

11. A nozzle assembly as claimed in claim 8 in which the ratio of r:R is in the range of 0.6 to 0.8.

* * * * *